United States Patent [19]

Matthew

[11] Patent Number: 5,074,129

[45] Date of Patent: Dec. 24, 1991

[54] FORMABLE FABRIC

[75] Inventor: John B. Matthew, Pittsfield, Mass.

[73] Assignee: Novtex, North Adams, Mass.

[21] Appl. No.: 456,540

[22] Filed: Dec. 26, 1989

[51] Int. Cl.[5] ..... D04B 21/08

[52] U.S. Cl. ..... 66/192

[58] Field of Search ..... 66/193, 192

[56] References Cited

U.S. PATENT DOCUMENTS

| | | | |
|---|---|---|---|
| 1,561,727 | 11/1925 | Kingman | 66/193 |
| 2,458,801 | 1/1949 | Schwartz | 66/193 X |
| 2,967,415 | 1/1961 | Ford et al. | 66/193 |
| 3,232,080 | 1/1966 | Inui | 66/192 |
| 3,256,130 | 6/1966 | Nisbet et al. | 66/193 X |
| 3,806,959 | 4/1974 | Gross | 66/192 X |
| 4,181,514 | 1/1980 | Lefkowitz et al. | 66/193 X |
| 4,518,640 | 5/1985 | Wilkens | 66/192 X |
| 4,743,472 | 5/1988 | Wilkens | 28/143 X |

FOREIGN PATENT DOCUMENTS

| | | | |
|---|---|---|---|
| 145288 | 12/1980 | German Democratic Rep. | 66/193 |

*Primary Examiner*—Werner H. Schroeder
*Assistant Examiner*—John J. Calvert
*Attorney, Agent, or Firm*—Sughrue, Mion, Zinn, Macpeak & Seas

[57] ABSTRACT

A formable, laterally stretchable fabric which retains its shape includes a plurality of laterally spaced longitudinally extending soft, formable metallic wires comprising the warps and a weft pattern of yarns which act to connect adjacent warps at staggered intervals. The knitted fabric is stretchable in the weft direction and the soft wires are caused to bend at or near the weft connecting points, thus holding the fabric in its reformed and/or stretched condition.

5 Claims, 1 Drawing Sheet

FORMABLE FABRIC

BACKGROUND OF THE INVENTION

1. Field of the Invention

The field relates generally to the production of machine made crochet knitted fabrics.

2. Description of Prior Art

Machine made crochet knitted fabrics may be produced in a broad range of widths, from as little as ⅛ inch or less depending on the closeness of the needle spacing in the crochet knitting machine, to as much as 60 inches or more depending on the total width of the needle bed. This textile fabrication method is commonly used for the production of narrow fabrics, particularly for the production of decorative trimmings and ribbons, and for the production of elastic webs for underwear waist bands, belts, and other apparel applications. The soft formable metallic wire may be formed of one material of the group consisting of copper, aluminum, soft steel and soft stainless steel.

SUMMARY OF THE INVENTION

The invention relates to a crochet knitted fabric which has the property of retaining its shape when stretched in the weft direction. It comprises a soft, permanently formable metallic wire inserted into the warps, and a weft pattern which acts to connect adjacent warps at staggered intervals, such that when the fabric is stretched in the weft direction, the soft formable wire is caused to bend at or near the weft connection points, thus permanently holding the fabric in its stretched condition. It is an object of the invention to provide a fabric which may be formed into complex reformed and/or stretched shapes and which will substantially permanently retain that shaped form without external support, and which can be reshaped as often as desired.

DESCRIPTION OF THE PREFERRED EMBODIMENT

Figure 1:
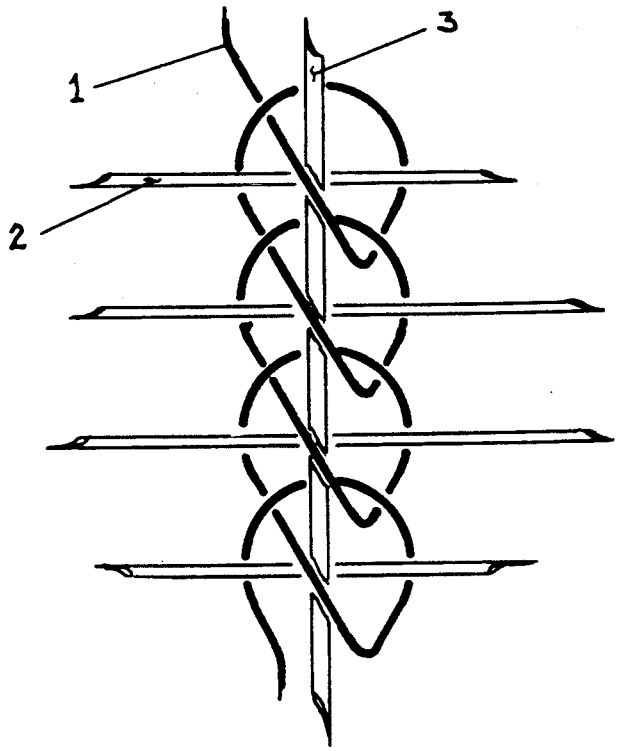
FIG. 1 is a greatly enlarged illustration of a single crochet knit warp of the type referred to in the preferred embodiment. It is to be understood that the invention relates to a fabric which comprises a plurality of such warps.
Figure 2:
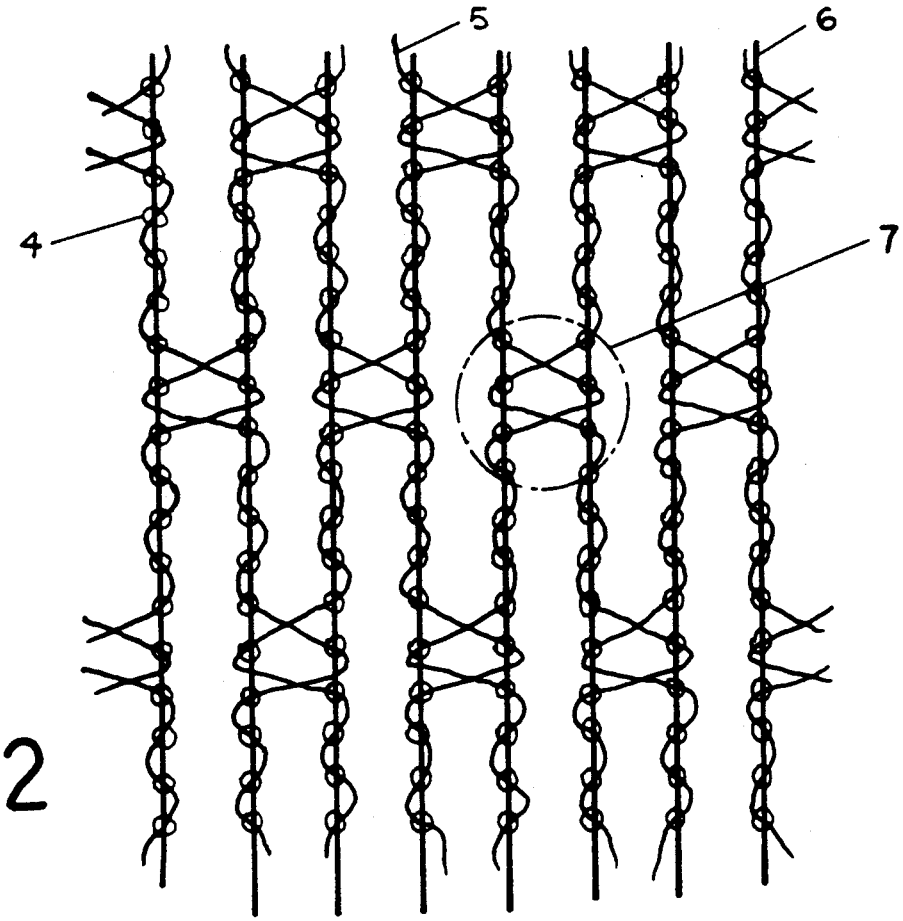
FIG. 2 is a diagrammatic illustration of a crochet knitted fabric with a weft pattern of the type referred to in the preferred embodiment. For the purpose of clarity, the warp yarns of the fabric are shown as small circles representing the individual crochet loops of the warps at the points where they engage the weft yarns, or insert yarns, or both.

Referring to FIGS. 1 and 2, an embodiment of the Formable Fabric is shown.

Referring in particular to FIG. 1, reference numeral 1 denotes a continuous warp yarn of natural or man-made material in the form of a chain stitch such as would be produced in a known manner on a crochet knitting machine. Reference numeral 2 denotes a weft yarn of natural or man-made material, engaged in a known manner by the individual loops in the chain stitch of the warp yarn 1. Reference numeral 3 denotes an insert element which comprises a soft, formable metallic wire or similarly formable element, and which is also engaged in a known manner by the individual loops in the chain stitch of the warp yarn 1.

Referring in particular to FIG. 2, reference numeral 4 denotes a plurality of crochet knit warps of the type described in FIG. 1. Reference numeral 5 denotes a plurality of weft yarns arranged according to an embodiment of the invention in a pattern that provides for connection of adjacent warps at staggered intervals. The specific pattern of weft yarns is controlled by the pattern bars of the crochet knitting machine. Reference numeral 6 denotes a plurality of insert elements, each of which according to an embodiment of the invention comprises a soft formable metallic wire or similarly permanently formable element. Reference numeral 7 denotes a region of the fabric pattern where the weft yarns act to connect adjacent warps.

Obviously the invention is not limited to the shown and described embodiment. Thus, the insert 6 may comprise a combination of elements which would include a soft, formable metallic wire or similarly formable element, together with a high strength reinforcing yarn such as fiberglass. Use of high strength reinforcing yarns together with the soft, formable metallic wire of the insert 6, and as an element of the weft yarn 5, provides a reinforcing fabric which can hold its shape, after stretching and reforming during the application and curing of plastic resins.

The invention is, thus, also applicable to the manufacture of decorative ribbons or tapes which will hold their shape when formed into bows or other decorative devices, in which case the warp yarns, weft yarns, and additional insert yarns may be of variously colored and highly decorative materials.

I claim:

1. A permanently formable knitted fabric comprising: a plurality of warps, soft permanently formable elements running substantially parallel to said warps, said warps comprising chain stitches engaging said soft permanently formable elements, and weft yarns interconnecting adjacent warps at connecting points defined by chain stitches at alternating intervals, and wherein said soft permanently formable elements are captured by at least two consecutive chain stitches of respective warps between said weft yarn interconnecting points at said alternating intervals, such that said fabric is formably stretchable in the weft direction with said formable elements being permanently deformed at and between the weft connecting points thereby permanently holding the fabric in a substantially deformed condition.

2. The formable knitted fabric as claimed in claim 1, wherein said permanently formable elements comprise soft metallic wires and said warps further comprise fiberglass high strength reinforcing yarns, and said weft yarns connect adjacent warps at said alternating intervals such that when the fabric is stretched in the weft direction said wires are deformed at and between the weft connecting points thus permanently holding said fiberglass reinforcing warp yarns of the fabric in a substantially deformed condition.

3. A formable knitted fabric according to claim 2, wherein said soft wires are formed of one material of the group consisting of copper, aluminum, soft steel and soft stainless steel.

4. The formable knitted fabric as claimed in claim 1, wherein said soft, formable elements comprise soft, formable metallic wires.

5. A formable knitted fabric as claimed in claim 4, wherein said soft, formable metallic wires are formed of one material of the group consisting of copper, aluminum, soft steel and soft stainless steel.

* * * * *